US006302831B1

(12) United States Patent
Henry

(10) Patent No.: US 6,302,831 B1
(45) Date of Patent: Oct. 16, 2001

(54) MARTIAL ARTS TRAINING DEVICE AND METHOD OF USE

(76) Inventor: Ralph I. Henry, 9816 Bolton Ave., Riverside, CA (US) 92503

( * ) Notice: Subject to any disclaimer, the term of this patent is extended or adjusted under 35 U.S.C. 154(b) by 0 days.

(21) Appl. No.: 09/392,603

(22) Filed: Sep. 9, 1999

(51) Int. Cl.[7] ..... A63B 69/34
(52) U.S. Cl. ..... 482/83; 482/87; 482/90
(58) Field of Search ..... 482/83–90, 96; 601/134–137

(56) References Cited

U.S. PATENT DOCUMENTS

| | | | | |
|---|---|---|---|---|
| D. 169,243 | * | 4/1953 | Doherty | 482/83 |
| 4,421,110 | * | 12/1983 | Delisle et al. | 601/134 |
| 4,434,980 | * | 3/1984 | Babineaux | 482/83 |
| 4,946,159 | * | 8/1990 | Jones | 482/83 |
| 5,183,450 | * | 2/1993 | Stelmach | 482/83 |
| 5,281,191 | * | 1/1994 | DeSousa | 482/83 |
| 5,470,304 | * | 11/1995 | Decanto | 482/83 |
| 5,800,319 | * | 9/1998 | Choate | 482/83 |
| 5,902,217 | * | 5/1999 | Schechner et al. | 482/83 |
| 6,063,011 | * | 5/2000 | Pelchat | 482/83 |

OTHER PUBLICATIONS

"Wing Chun Dummy" See Attached Brochure of Martial Arts Training Device which Rigidly Attaches to the Floor or a Wall.

* cited by examiner

*Primary Examiner*—Jerome Donnelly
(74) *Attorney, Agent, or Firm*—Timothy Thut Tyson; Ted Masters; Freilich, Hornbaker & Rosen

(57) ABSTRACT

A martial arts training device (20) for a punching bag (500) having an outer surface (502) includes a covering (22) which is attachable to a portion of the outer surface of the punching bag. The covering is fixedly attached to the punching bag by one or more connectors (24). One or more arms (32) are connected to the covering in a rigid fashion, so that when a martial arts blow is delivered to the arm, the arm does not move with respect to the punching bag. Rather, the force of the blow is transferred from the arm to the punching bag causing the punching bag to move, as would a martial arts opponent. In a preferred embodiment, the arm has a flange (36) which is captively held between the covering and the punching bag.

9 Claims, 8 Drawing Sheets

Fig. 2
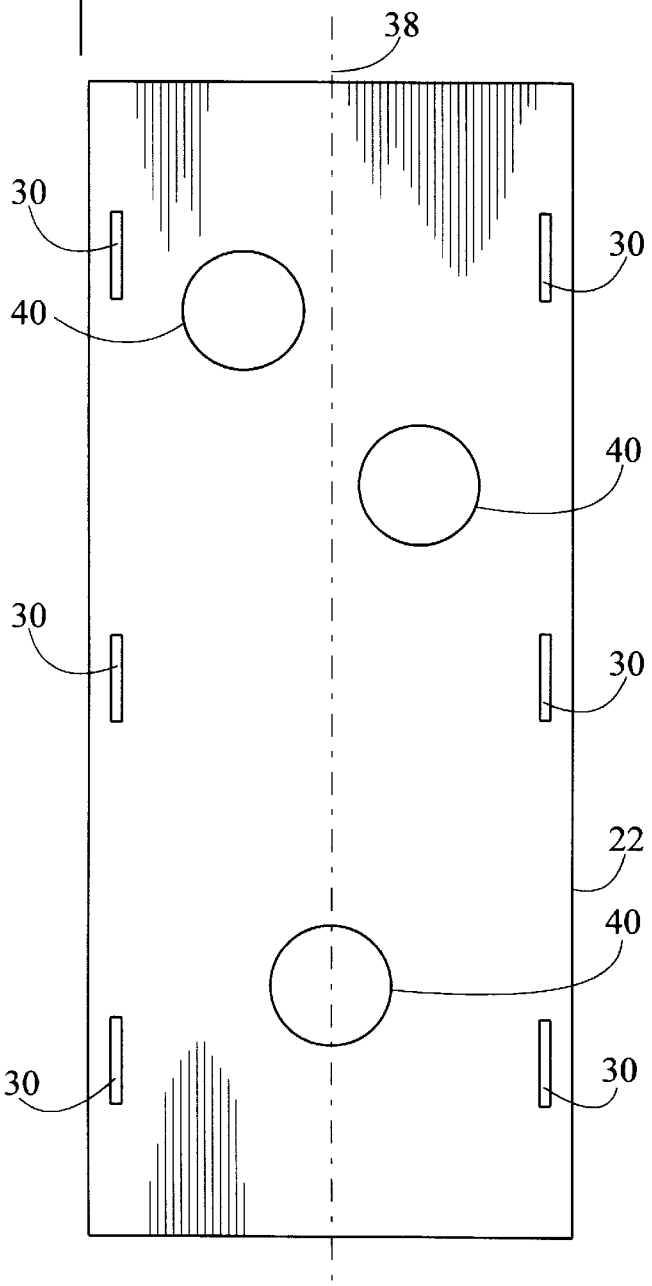
Fig. 4
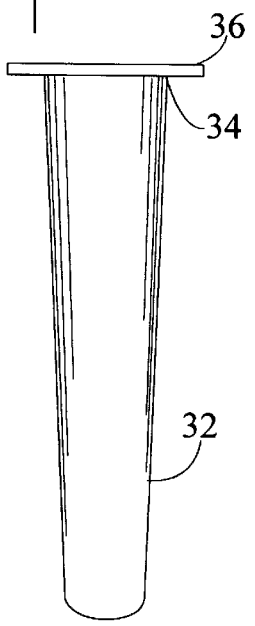
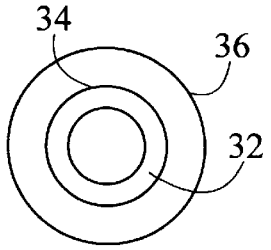
Fig. 3
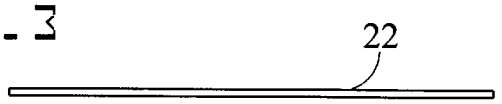
Fig. 5

500
24
20
26
22
A
32
502
D
504
C
B
32

MARTIAL ARTS TRAINING DEVICE AND METHOD OF USE

TECHNICAL FIELD

The present invention pertains generally to the field of martial arts, and in particular to a martial arts training device which can be removably attached to a conventional punching bag.

BACKGROUND ART

Martial arts training devices for developing skill in martial arts are well known in the art. These devices provide simulated aims and legs for practicing various martial arts techniques. In one category of trig device, an attachment is connected to a conventional punching bag. For example, U.S. Pat. No. 5,697,872 illustrates a martial arts training device which attaches to a cylindrical heavy bag. The training devices includes an elongated tubular member (arm) having a first and second distal portions, wherein the tubular member has a first arcuate bend adapted to matingly engage the exterior of the heavy bag along a circumference thereof. An elongated elastomeric member having opposed ends fixed to the tubular member secures the tubular member about the bag. And, U.S. Pat. No. 5,800,319 defines a sparring device composing a columnar member, such as a punching bag, and a sparring member. The sparring member includes a belt portion which is fastened upon the columnar member. The sparring member also includes at least one arm portion which is normally disposed in a horizontal direction with its inner end joined to the bell portion and its outer end in at least one arcuate path the radius of which extends from the inner end of the arm portion. In both of the aforementioned devices, because of the manner in which the arms are attached, when the arms are struck with a martial arts blow, they freely move or gyrate with respect to the punching bag. This movement poorly simulates the resistance that would typically be offered by a martial arts opponent.

Another type of martial arts training device comprises a rigidly mounted tree-like "dummy" made of plastic or wood. The dummy has a plurality of rigidly attached protruding limbs which are used to practice blocking and hitting maneuvers. Since the limbs are rigidly attached to the dummy, and the dummy is rigidly attached to a support structure such as the floor or a wall, when the limbs are hit they do not move at all. Here too the simulation of an actual opponent is seriously lacking.

DISCLOSURE OF INVENTION

The present invention is directed to an improved martial arts training device which overcomes the disadvantages of prior art devices. In the present invention the arms are rigidly attached to the punching bag, so that when the arms are struck they do not move with respect to the punching bag, but rather cause the suspended punching bag to move. In this manner, the normal resistance offered by the limbs and body of a martial arts opponent is accurately simulated. Additionally, the present invention is much less expensive than the rigid dummy-type training devices currently available on the market.

In accordance with a preferred embodiment of the invention, a martial arts training device for removable attachment to a punching bag having an outer surface includes a covering which rigidly attaches to a portion of the outer surface of the punching bag. One or more connectors fixedly hold the covering in place on the punching bag. One or more outwardly projecting arms have an inward end having a flange. The martial arts training device is attached to the punching bag so that the flange is captively disposed between the covering and the punching bag.

In accordance with an important aspect of the invention, once attached, the arm is substantially immovable with respect to the punching bag.

In accordance with an important feature of the invention, the arm may either be oriented horizontally, or may be oriented downward to simulate a leg.

In accordance with another important aspect of the invention, three arms are utilized.

In accordance with another important feature of the invention, the arm tapers outwardly toward its tip.

In accordance with another preferred embodiment of the invention, the arm is rigidly connected to the covering.

In accordance with another important aspect of the invention, the arm is integrally molded with the covering to form a single unit.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 2 is a front elevation view of a covering in a substantially flattened state;

FIG. 3 is a top plan view of the covering;

FIG. 4 is a top plan view of an outwardly projecting arm;

FIG. 5 is a front elevation view of the arm;

MODES FOR CARRYING OUT THE INVENTION

Figure 1:
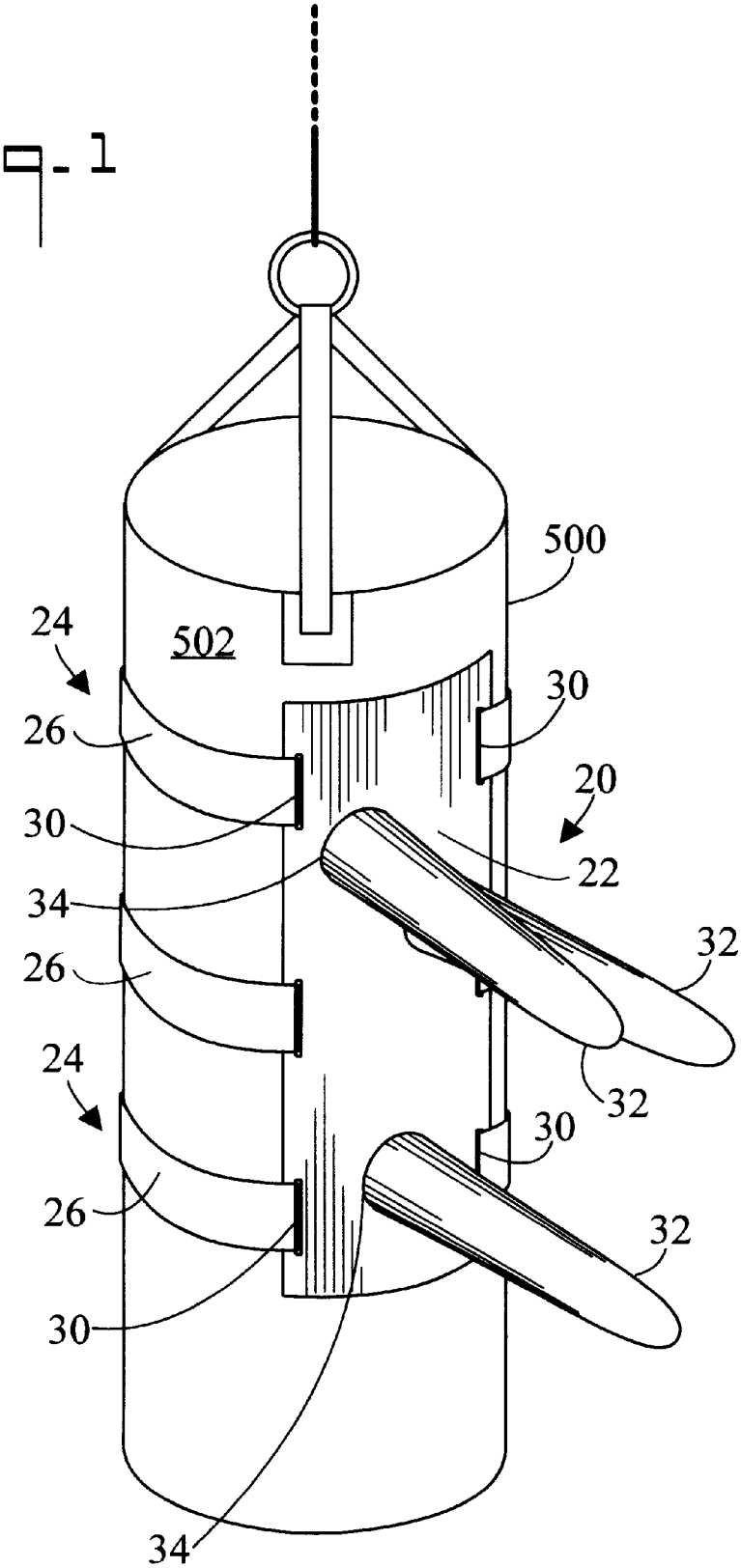
FIG. 1 is a reduced perspective view of the martial arts training device in accordance with the present invention attached to a punching bag.

Referring initially to FIG. 1, there is illustrated a perspective view of a martial arts training device in accordance with the present invention, generally designated as 20. The martial arts training device 20 removably attaches to the outer surface 502 of punching bag 500. The punching bag 500 can be of the shown "heavy bag" variety, or alternatively can be a "free-standing bag" wherein the bottom is weighted with sand or water. Martial arts training device 20 includes a covering 22 which is attachable to a portion of the outer surface 502 of punching bag 500. In a preferred embodiment covering 22 comprises a sheet of material which is shapably conformable to outer surface 502, and is fabricated from a flexible polymer such as polypropylene or a polycarbonate such as sold under the trademark Lexan by General Electric Company of Schenectady, N.Y. However, other materials such as leather could also be utilized. At least one connector 24 is utilized for fixedly attaching covering 22 to the punching bag 500. In the shown preferred embodiment, three connectors 24 are utilized. Also referring to FIG. 6, connector 24 comprises a pair of straps or belts 26 having connection means disposed at their ends. In a preferred embodiment, the connection means includes hook and loop fasteners 28 such as sold under the trademark Velcro by Velcro Industries B.V., of Curacao, Netherlands Antilles. However, it may be readily appreciated that other devices such as buckles could also be employed. Straps 26 are attached to covering 22 via slots Connector 24 surrounds punching bag 500 and captively holds covering 22 firmly in place against outer surface 502 of punching bag 500. At least one outwardly projecting arm 32 has an inward end 34 having a flange 36 (also refer to FIG. 4). When martial arts training device 20 is attached to punching bag 500, flange 36 is captively disposed between covering 22 and punching bag 500 (refer also to FIG. 10). When connector 24 is tightened, covering 22 urges flange 36 toward punching bag 500, so that arm 32 is fixedly disposed with respect to both punching bag 500 and covering 22, and arm 32 is substantially immovable with respect to punching bag 500. In this configuration, when a martial arts blow is delivered to arm 32, arm 32 will not gyrate, but rather the force of the blow will be transferred to punching bag 500 causing it to move, much as would a martial arts opponent. In a preferred embodiment three outwardly tapered arms 32 are utilized, each having a substantially horizontal orientation. In another preferred embodiment, the lower "arm" 32 is oriented downward thereby simulating the "leg" of an opponent (refer to FIG. 12).

The shape and placement of arms 32 is in accordance with well known martial arts specifications. In a preferred embodiment, covering 22 has a central vertical axis 38 (also refer to FIG. 7). A first arm 32*a* is disposed to the left of central vertical axis 38. A second arm 32*b* is disposed to the right of central vertical axis 38 and slightly below said first arm 32*a*. And, a third arm 32*c* is disposed substantially on vertical axis 38 and below second arm 32*b*. Arms 32 can be fabricated from a variety of materials including a blow or injection molded polymer-material, or wood.

FIG. 2 is a front elevation view of covering 22 in a substantially flattened state. Covering 22 has a hole 40 shaped and dimensioned to receive arm 32, and captively engage flange 36 (refer also to FIG. 4). In the shown preferred embodiment, three holes 40 are provided for three arms 32.

FIG. 3 is a top plan view of covering 22.

FIG. 4 is a top plan view of outwardly projecting arm 32, showing inward end 34, flange 36, and the outward taper.

FIG. 5 is a front elevation view of arm 32.

Figure 6:
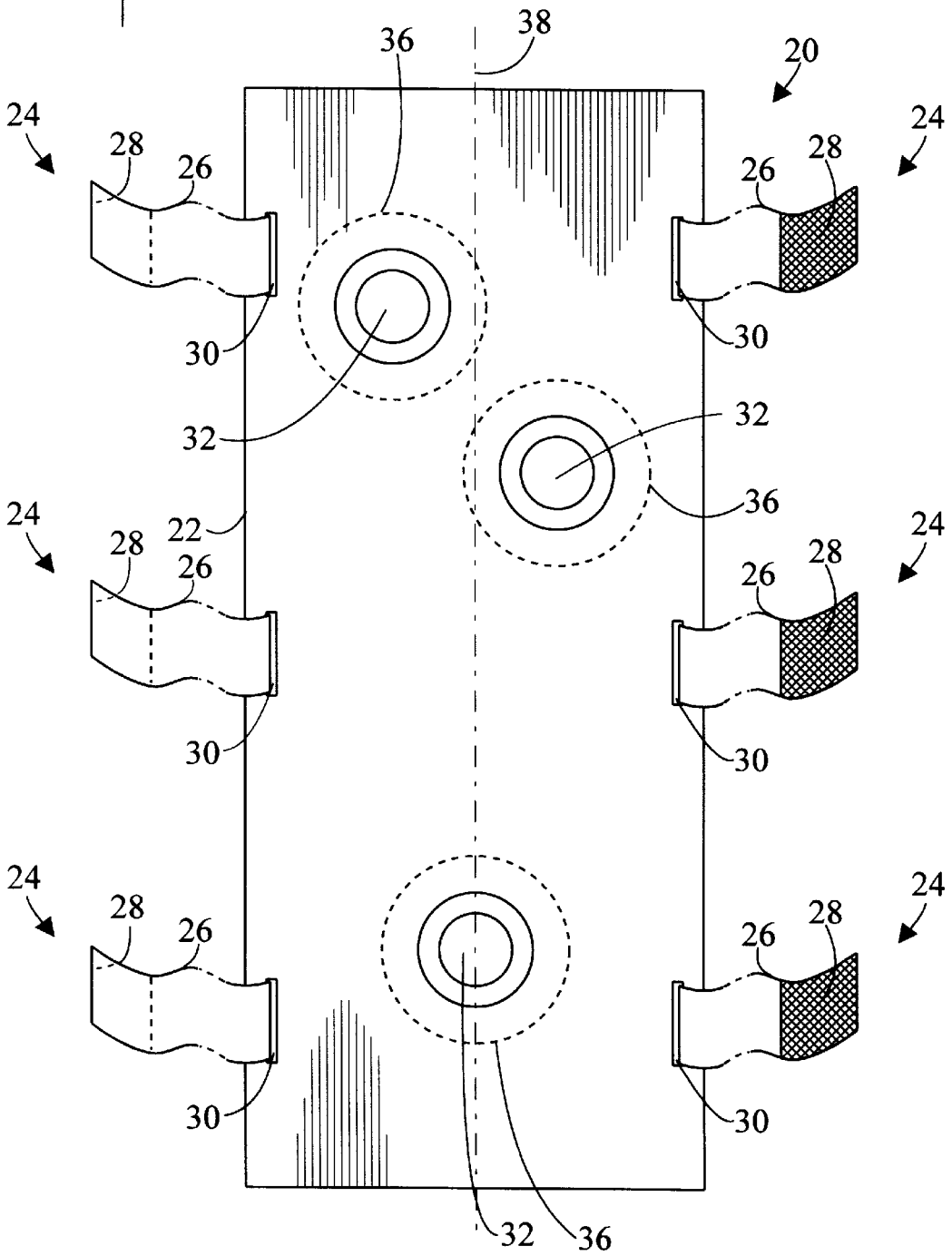
FIG. 6 is a front elevation view of a martial arts training device in accordance with the present invention.

FIG. 6 is a front elevation view of martial arts training device 20, showing three arms 32, two connectors 24, and covering 22.

Figure 7:
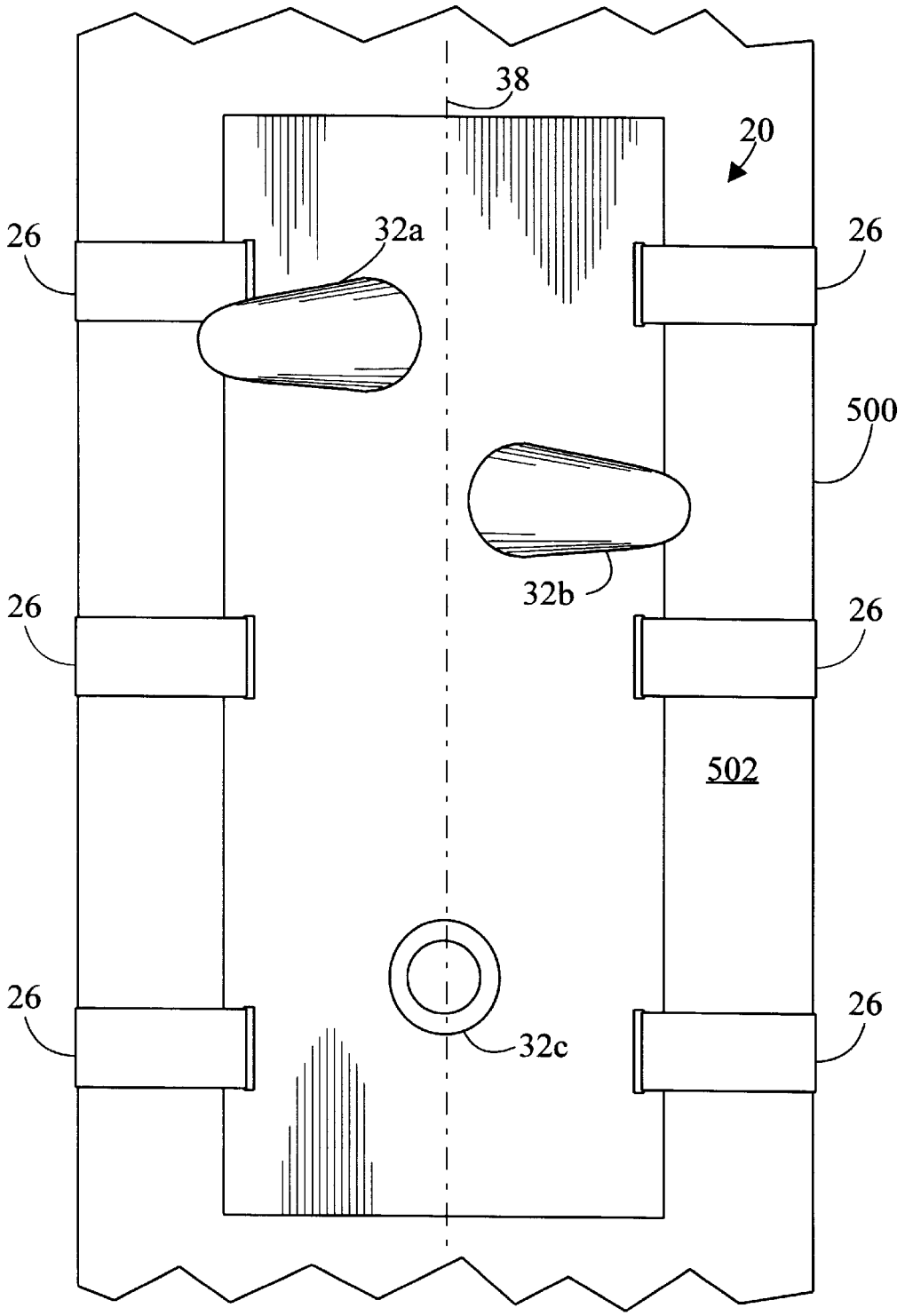
FIG. 7 is a fragmented front elevation view of the martial arts training device attached to a punching bag.

FIG. 7 is a fragmented front elevation view of martial arts training device 20 attached to punching bag 500.

Figure 8:
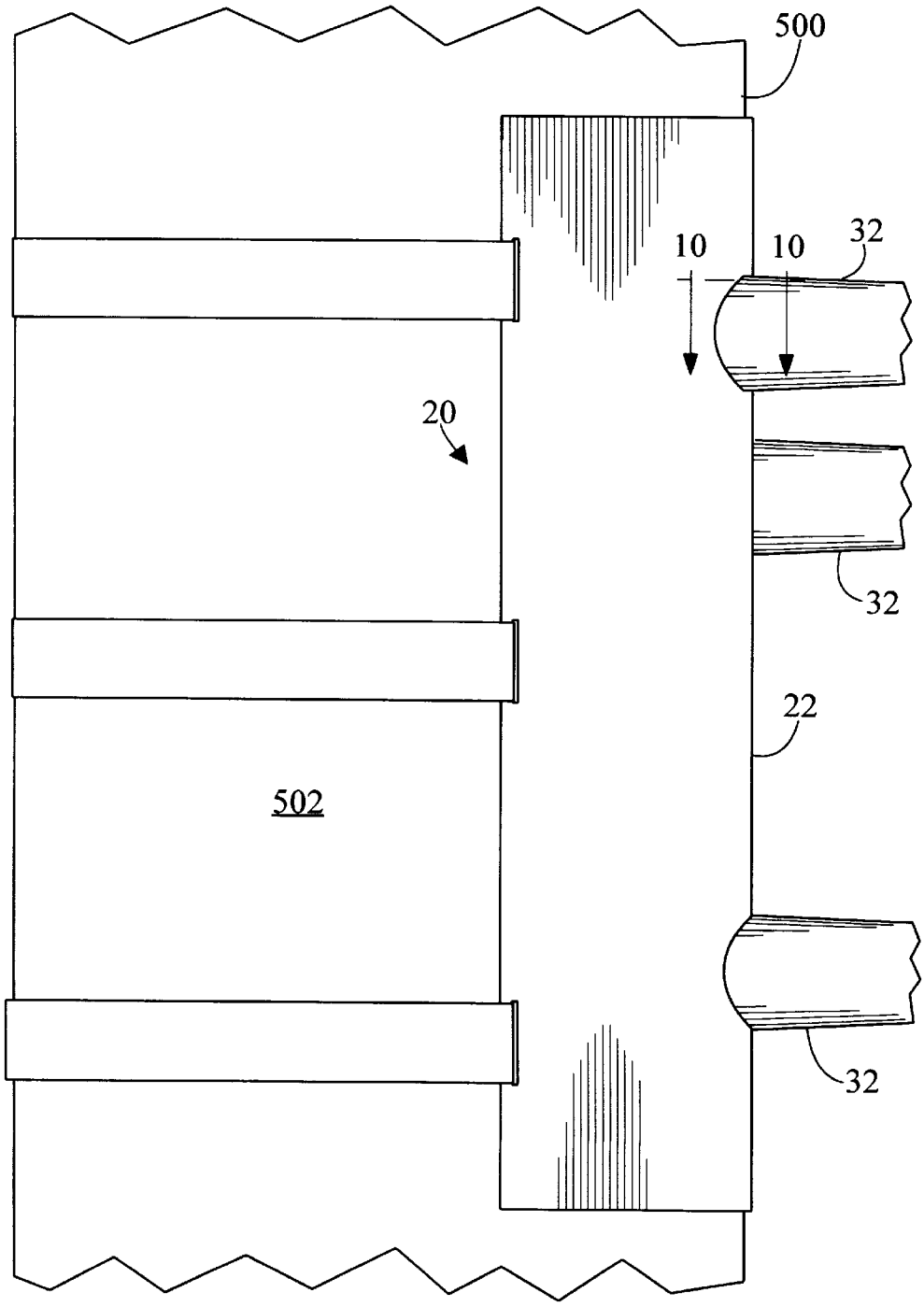
FIG. 8 is a fragmented side elevation view of the martial arts training device attached to the punching bag.

FIG. 8 is a fragmented side elevation view of martial arts training device 20 attached to punching bag 500.

Figure 9:
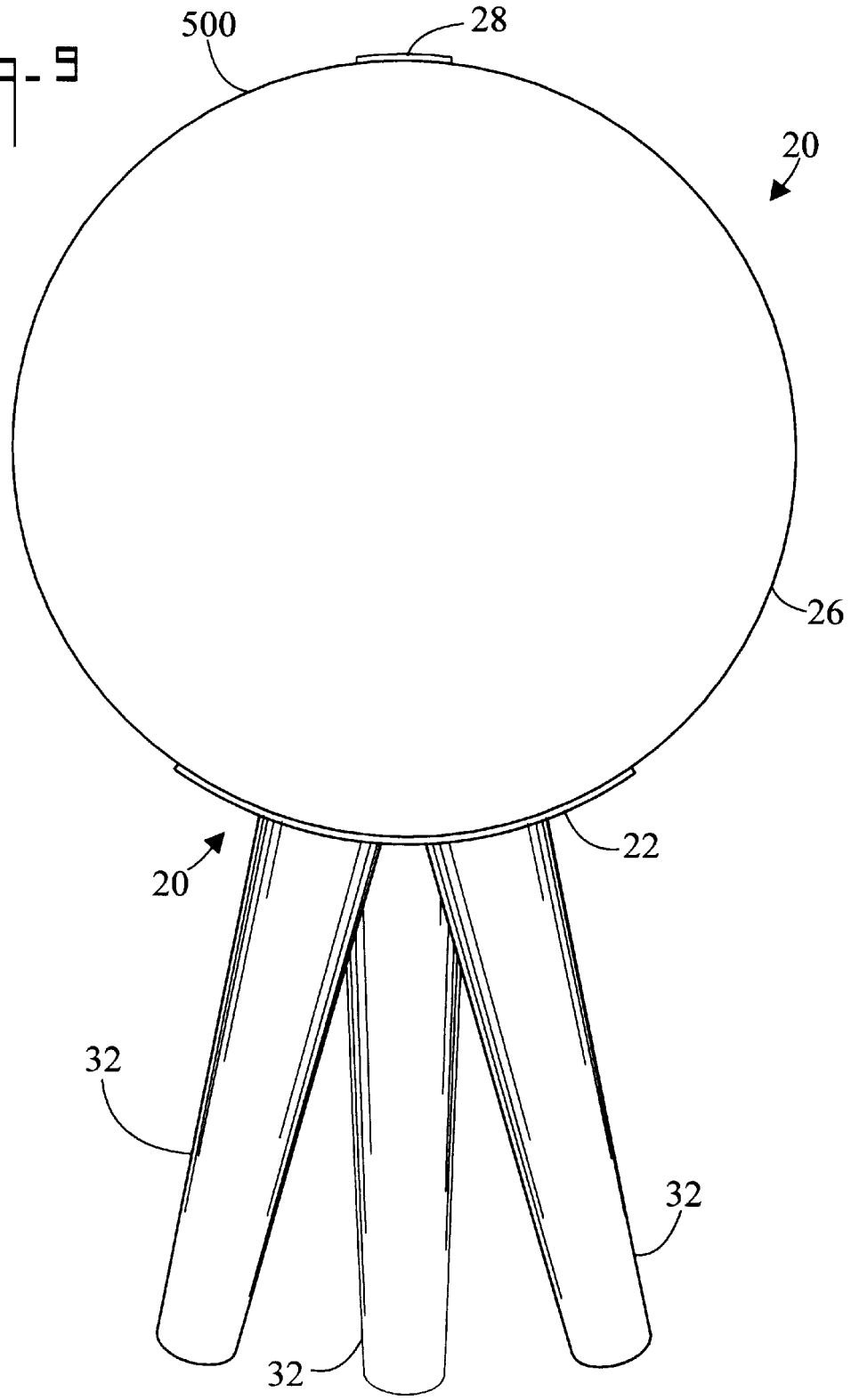
FIG. 9 is a top plan view of the martial arts training device attached to the punching bag.

FIG. 9 is a top plan view of martial arts training device 20 attached to punching bag 500.

Figure 10:
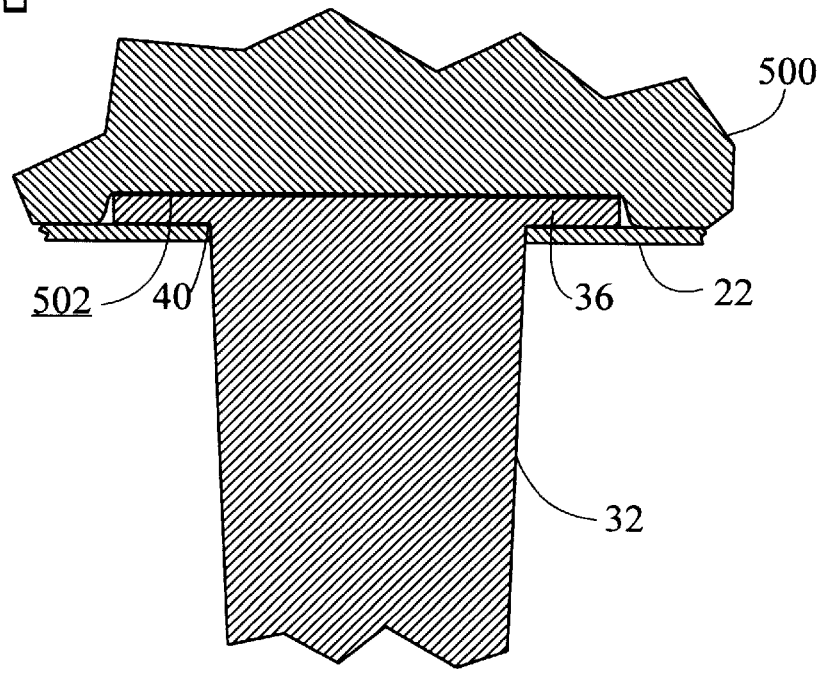
FIG. 10 is a fragmented cross sectional view along the line 10—10 of FIG. 8 showing how the covering, arm; and punching bag are connected.

FIG. 10 is a fragmented cross sectional view along the line 11–10 of FIG. 8 showing how covering 22, arm 32, and punching bag 500 are connected. Flange 36 of arm 32 is fixedly captured between covering 22 and the surface 502 of punching bag 500, so that arm 32 is substantially immovable with respect to punching bag 500.

Figure 11:
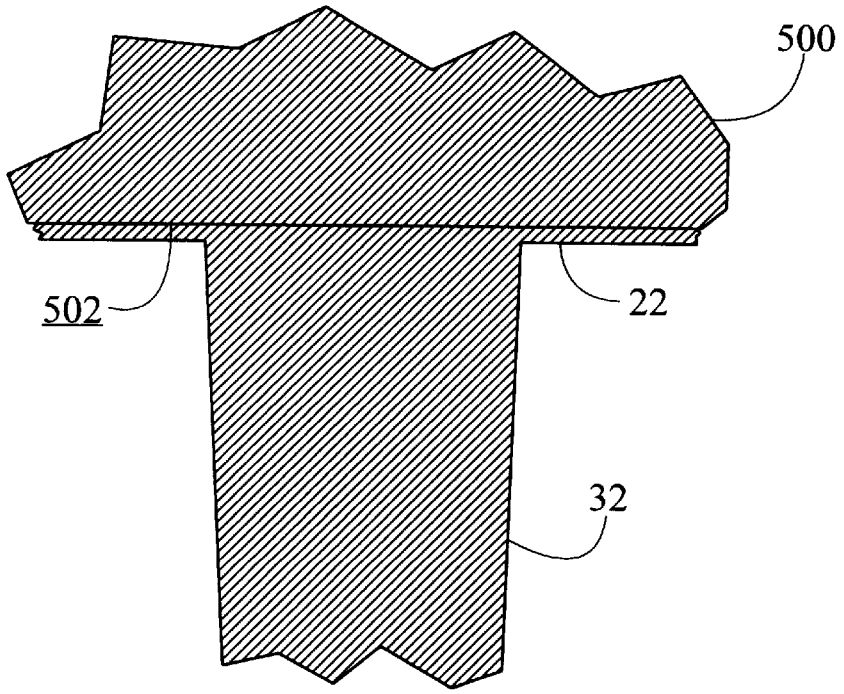
FIG. 11 is a fragmented cross sectional view similar to FIG. 10 showing a second connection embodiment; and, FIG. 12 is a reduced perspective view of the martial arts training device being used by a martial arts student.

FIG. 11 is a fragmented cross sectional view similar to FIG. 10 showing a second connection embodiment of arm 32. In this embodiment, outwardly projecting arm 32 is fixedly attached to covering 22. In the shown preferred embodiment, arm 32 is integrally molded with covering 22 to form a single unit. It may be readily appreciated however, that the connection of arm 32 to covering 22 could be effected by numerous mechanical means well know in the art.

Figure 12:
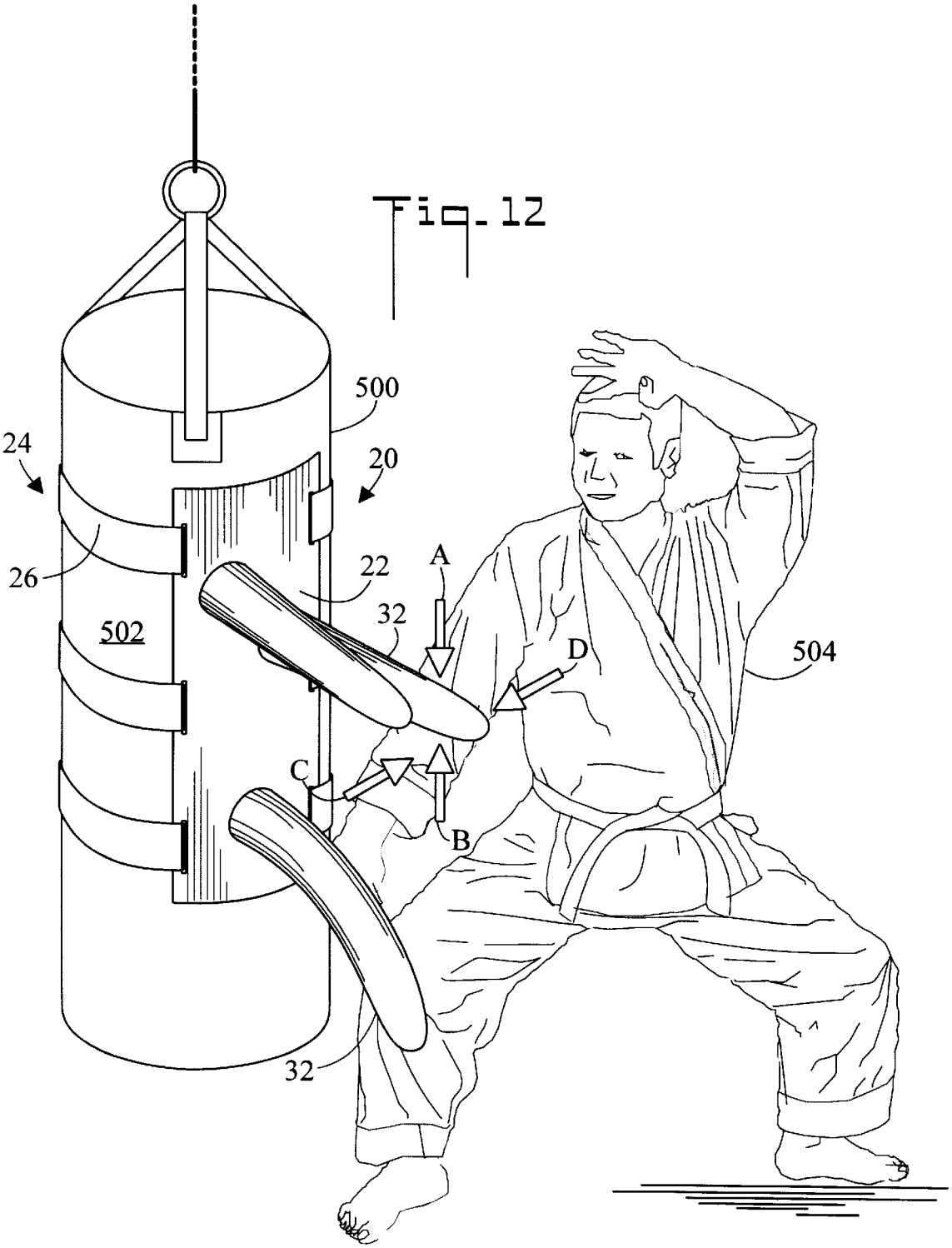

FIG. 12 is a reduced perspective view of martial arts training device 20 being used by a martial arts student 504. It is noted that arm 32 is substantially immovable with respect to punching bag 500, so that blows directed to arm 32 in any direction (e.g. vertical directions A and B, horizontal directions C and D) are transferred to punching bag 500. It is also noted that in this embodiment, the lowest arm is bent downward to simulate the leg of an opponent.

In terms of use, arm 32 is inserted through hole 40 so that hole 40 captively engages flange 36. Covering 22 is then fitted around a portion of outer surface 502 of punching bag 500 so that flange 36 is captively disposed between covering 22 and surface 502 of punching bag 500. Using connector 24, covering 22 is fixedly attached to punching bag 500 so that arm 32 is substantially immovable with respect to punching bag 500. A martial arts student 504 then strikes arm 32 in accordance with established martial arts techniques.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A martial arts training device for a punching bag having an outer surface, comprising:

a covering attachable to a portion of the outer surface of the punching bag;

at least one connector for fixedly attaching said covering to the punching bag;

at least one outwardly projecting arm fixedly attached to said covering, said at least one outwardly projecting arm shaped and dimensioned to simulate a limb of a martial arts opponent, said at least one outwardly projecting arm having an inward end having a flange, said flange captively disposable between said covering and the punching bag; and, said arm rigidly attachable to said punching bag so that when a martial as blow is delivered to said arm, said arm will not move with respect to the punching bag.

2. A martial arts training device according to claim 1, further including said at least one outwardly projecting arm oriented substantially horizontally.

3. A martial arts training device according to claim 1, further including said at least one outwardly projecting arm oriented downwardly.

4. A martial arts training device according to claim 1, further including said at least one outwardly projecting arm including three outwardly projecting arms.

5. A martial arts training device according to claim 4, further including:

said covering having a central vertical axis;

a first arm of said three outwardly projecting arms disposed to the left of said central vertical axis;

a second arm of said three outwardly projecting arms disposed to the right of said central vertical axis; and, a third arm of said three outwardly projecting arms disposed substantially on said vertical axis.

6. A martial arts training device according to claim 1, further including said at least one outwardly projecting arm outwardly tapered.

7. A martial arts training device according to claim 1, wherein said at least one outwardly projecting arm is integrally molded with said covering.

8. A martial arts training device according to claim 1, wherein said at least one connector for fixedly attaching said covering to the punching bag is three connectors.

9. A method for practicing martial arts, comprising:

providing a punching bag having an outer surface;

providing a martial arts training device, said martial arts training device comprising a covering attachable to a portion of said outer surface of said punching bag, at least one connector for fixedly attaching said covering to said punching bag, at least one outwardly projecting arm having an inward end having a flange, and said covering having a hole which said arm but not said flange is passable therethrough;

inserting said outwardly projecting arm trough said hole until said flange is captively engaged by said covering;

fitting said covering around a portion of said outer surface of said punching bag so that said flange is captively disposed between said covering and said punching bag;

using said at least one connector, fixedly attaching said covering to said punching bag so that said at least one outwardly projecting arm is rigidly attached to said punching bag so that when a martial arts blow is delivered to said arm, said arm will not move with respect to said punching bag; and, striking said at least one outwardly projecting arm in accordance with established martial arts techniques.

* * * * *